US008186444B2

(12) United States Patent
Patel

(10) Patent No.: US 8,186,444 B2
(45) Date of Patent: May 29, 2012

(54) FLOW CONTROL VALVE PLATFORM

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/192,640

(22) Filed: Aug. 15, 2008

(65) Prior Publication Data

US 2010/0038093 A1 Feb. 18, 2010

(51) Int. Cl.
*E21B 34/06* (2006.01)

(52) U.S. Cl. ..... 166/373; 166/319

(58) Field of Classification Search ..... 166/373, 166/319

See application file for complete search history.

(56) References Cited

U.S. PATENT DOCUMENTS

| | | | | |
|---|---|---|---|---|
| 2,537,066 | A * | 1/1951 | Lewis | 166/115 |
| 5,868,201 | A * | 2/1999 | Bussear et al. | 166/53 |
| 6,276,458 | B1 * | 8/2001 | Malone et al. | 166/386 |
| 6,298,916 | B1 | 10/2001 | Tibbles et al. | |
| 6,321,842 | B1 | 11/2001 | Pringle et al. | |
| 6,325,153 | B1 * | 12/2001 | Harrell | 166/386 |
| 6,357,525 | B1 * | 3/2002 | Langseth et al. | 166/264 |
| 6,598,682 | B2 | 7/2003 | Johnson et al. | |
| 6,668,935 | B1 | 12/2003 | McLoughlin et al. | |
| 6,863,129 | B2 | 3/2005 | Ohmer et al. | |
| 6,966,380 | B2 | 11/2005 | McLoughlin et al. | |
| 6,973,974 | B2 | 12/2005 | McLoughlin et al. | |
| 7,240,739 | B2 | 7/2007 | Schoonderbeek et al. | |
| 7,258,323 | B2 | 8/2007 | Dwivedi | |
| 7,331,398 | B2 | 2/2008 | Dwivedi et al. | |
| 7,422,065 | B1 * | 9/2008 | Wintill et al. | 166/332.1 |
| 7,451,825 | B2 * | 11/2008 | Jonas | 166/373 |
| 2003/0141061 | A1 * | 7/2003 | Hailey et al. | 166/278 |
| 2003/0188871 | A1 * | 10/2003 | Dusterhoft et al. | 166/308 |
| 2003/0196820 | A1 * | 10/2003 | Patel | 166/387 |
| 2005/0034875 | A1 | 2/2005 | McLoughlin et al. | |
| 2006/0027377 | A1 | 2/2006 | Schoonderbeek et al. | |
| 2006/0278399 | A1 | 12/2006 | Dwivedi et al. | |
| 2006/0284134 | A1 | 12/2006 | Dwivedi | |
| 2007/0012454 | A1 | 1/2007 | Ross et al. | |
| 2007/0044956 | A1 | 3/2007 | Jonas | |
| 2007/0163774 | A1 | 7/2007 | Hosatte et al. | |
| 2007/0257225 | A1 | 11/2007 | Dwivedi | |
| 2009/0078428 | A1 * | 3/2009 | Ali | 166/373 |
| 2009/0120647 | A1 * | 5/2009 | Turick et al. | 166/373 |
| 2009/0218089 | A1 * | 9/2009 | Steele et al. | 166/53 |
| 2012/0006563 | A1 * | 1/2012 | Patel et al. | 166/373 |

OTHER PUBLICATIONS

Dictionary definition of "remove", accessed via thefreedictionary.com Nov. 8, 2011.*

* cited by examiner

*Primary Examiner* — Jennifer H Gay
*Assistant Examiner* — Blake Michener
(74) *Attorney, Agent, or Firm* — Brandon S. Clark

(57) ABSTRACT

A system that is usable with a well includes a tubing string that extends into an isolated zone of the well and a plurality of chokes modules that are disposed in the isolated zone to control communication between a passageway of the tubing string and the zone. Each choke module includes an associated choke, which is removable from the choke module without disassembly of the tubing string. Each choke module is independently controllable relative to the other choke module (s) to selectively enable and disable flow through the associated choke.

19 Claims, 14 Drawing Sheets

FLOW CONTROL VALVE PLATFORM

BACKGROUND

The invention generally relates to a flow control valve platform.

A typical well may include flow control valves for purposes of managing communication of injection and/or production fluids. One type of conventional flow control valve is an "on/off" valve that has two states: an on state in which a flow is communicated through the flow passageway of the valve; and an off state to block fluid communication through the flow passageway. Another type of conventional flow control valve is a "choke," a valve whose effective cross-sectional flow path area may be varied for purposes of controlling the rate of production or injection through the valve.

Regardless of whether the flow control vale is an on/off valve or a choke, a typical flow control valve may be a sleeve-type valve that generally includes a single sliding sleeve and an actuator for moving the sleeve to cover or uncover flow ports on a mandrel of the valve. The sleeve of a choke may have multiple open positions, each of which is associated with a different flow area (to accommodate different reservoir conditions) and a different set of flow ports on the mandrel. The choke may further include an indexing or counter mechanism for cycling the choke from one open position to another.

Using a conventional flow control valve may encounter several challenges. The indexing or counter mechanisms of a variable choke typically are complex and expensive. Additionally, the power or force, which is used to move the sliding sleeve against the differential pressure downhole in the well may be typically high due to the large size of the seals. This generally means that a relatively high operating pressure is used to drive the sleeve, which may require the generation of a relatively high pressure at the surface of the well.

Flow control valves are not typically scalable. Therefore, differently-sized tubings require differently-sized chokes so that the flow path through the tubing is not unduly restricted by the central flow path through the mandrel of the choke. Furthermore, flow control valves for oil producers may be different than flow control valves for water injectors.

Thus, there exists a continuing need for a flow control valve platform that addresses one or more of the challenges that are set forth above as well as other unidentified challenges.

SUMMARY

In an embodiment of the invention, a system that is usable with a well includes a tubing string that extends into an isolated zone of the well and a plurality of choke modules that are disposed in the isolated zone to control communication between a passageway of the tubing string and the zone. Each choke module includes an associated choke, which is removable from the choke module without disassembly of the tubing string. Each choke module is independently controllable relative to the other choke module(s) to selectively enable and disable flow through the associated choke.

In another embodiment of the invention, a technique that is usable with a well that has a plurality of isolated zones and a tubing includes in each zone, providing a set of choke modules to control communication between a passageway of the tubing and the zone. Each choke module includes an associated choke that is removable from the choke module without disassembly of the tubing, and each choke module is independently controllable relative to the other choke module(s) of the set. For each zone, one or more of the choke modules are selected, and the selected choke module(s) are configured to communicate fluid between the passageway of the tubing and the zone; and for each zone, fluid communication through the unselected choke module(s) is closed.

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
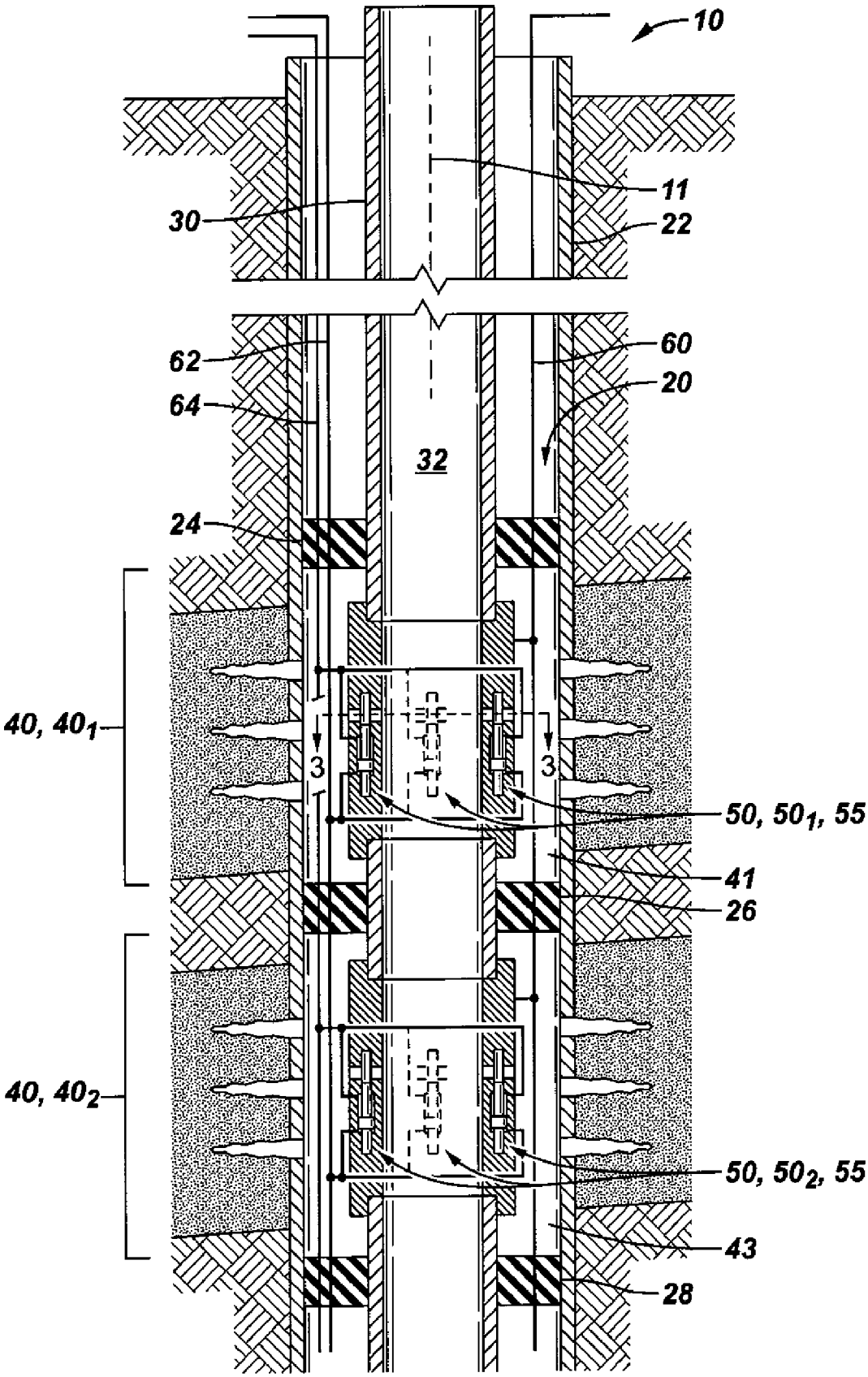
FIGS. 1 and 2 are schematic diagrams of exemplary well flow control systems according to embodiments of the invention.

Referring to FIG. 1, a well 10 includes a wellbore 20 that extends downhole through various production or injection zones 40 (exemplary zones $\mathbf{40}_1$ and $\mathbf{40}_2$, being depicted in FIG. 1 as examples). A tubing string 30 (a production tubing string or an injection string, as examples) extends downhole into the wellbore 20 through the zones 40. As shown in FIG. 1, the wellbore 20 may be cased by a casing string 22. However, in accordance with other embodiments of the invention, the wellbore 20 may be uncased. It is noted that the well 10 may be a subterranean or subsea well, depending on the particular embodiment of the invention. Thus, many variations are contemplated and are within the scope of the appended claims.

Depending on the particular embodiment of the invention, the tubing string 30 may receive fluid, such as oil or gas for example, from a particular zone 40 and communicate the oil or gas to the surface of the well 10; or alternatively, the tubing string 30 may deliver fluids that are injected into a particular zone 40. Each zone 40 is an isolated zone that may be formed between isolation devices, such as, for example, packers that form annular seals between the exterior surface of the tubing string 30 and the interior surface of the casing string 22 (for embodiments of the invention in which the wellbore 20 is cased). Thus, for example, the upper zone $\mathbf{40}_1$ depicted in FIG. 1 is formed between two packers 24 and 26; and the lower zone $40_2$ is formed between two packers 26 and 28. It is noted that the well 10 may have a single zone 40 or may have more than two zones, in accordance with other embodiments of the invention.

For purposes of regulating the production or injection from/to a particular zone 40, the well 10 has a flow control valve platform system that is formed from multiple flow control stations 50 (two exemplary flow control stations $50_1$ and $50_2$ are depicted in FIG. 1). Each station 50 is disposed in a particular zone 40, and each station 50 contains flow control valve cartridges, or modules 55, which are located around the perimeter of the tubing string 30 (distributed outside the tubing string 30 around a longitudinal axis 11 of the string 30, for example) for purposes of regulating the communication of fluid between the annulus and a central passageway 32 of the tubing string 30.

More specifically, in accordance with embodiments of the invention described herein, the modules 55 of each station 50 may contain at least some differently-sized chokes (i.e., each choke may have a different cross-sectional flow area). While in other embodiments, the modules 55 of each station may contain at least some of the same-sized chokes (i.e each choke may have a substantially identical cross-sectional flow area). Each module 55 is independently configurable to either allow fluid communication through its choke or to block such communication. More particularly, for purposes of controlling fluid communication at a particular station 50, one or more choke modules 55 may be selected to communicate fluid between the annulus and the central passageway 32 of the tubing string 30, and no fluid communication may occur through the remaining unselected chokes. Thus, one or more of the modules 55 of the station $50_1$ may be selected for purposes of communicating fluid between an annulus 41 of the zone 40 and the central passageway 32; and likewise, one or more of the modules 55 of the station $50_2$ may be selected for purposes of communicating fluid between an annulus 43 of the zone $40_2$ and the central passageway 32.

By selecting the chokes in this manner, the effective cross-sectional flow area between the zone and the tubing 30 may be regulated. Therefore, should downhole conditions change in a particular zone 40, the choke modules 55 of the appropriate station 50 may be reconfigured to establish a new effective cross-sectional flow area in order to address the change.

In general, each module 55 includes an on/off valve that may be controlled from the Earth surface of the well, from downhole autonomous circuitry or from another location for purposes of selecting whether fluid communication occurs through the choke of the module 55. It is noted that depending on the particular embodiment of the invention, only a single module 55 of the station 50 may be opened or multiple modules 55 of the station 50 may be opened. Thus, many variations are contemplated and are within the scope of the appended claims.

As further described below, the modules 55 may be circumferentially arranged around the exterior of the tubing string 30, which permits relatively easy access to the chokes for purposes of replacing or changing choke sizes. Thus, unlike conventional arrangements, the chokes may be easily exchanged to suit the particular downhole application. Furthermore, the internal central passageway of the station 50 is independent of the chokes or choke sizes. By allowing access to the chokes outside of the tubing string 30, the string 30 does not need to be disassembled for purposes of accessing or changing out a choke.

As further described below, in accordance with embodiments of the invention, two hydraulic control lines 62 and 64 and an electric line 60 are used for purposes of selecting the states (open or closed) of a module 55. Although the lines 60, 62 and 64 are depicted as extending to the surface of the well 10, it is noted that the module states 50 may be changed autonomously by intelligent circuitry located downhole in or in proximity to the stations 50, in accordance with other embodiments of the invention.

Figure 2:
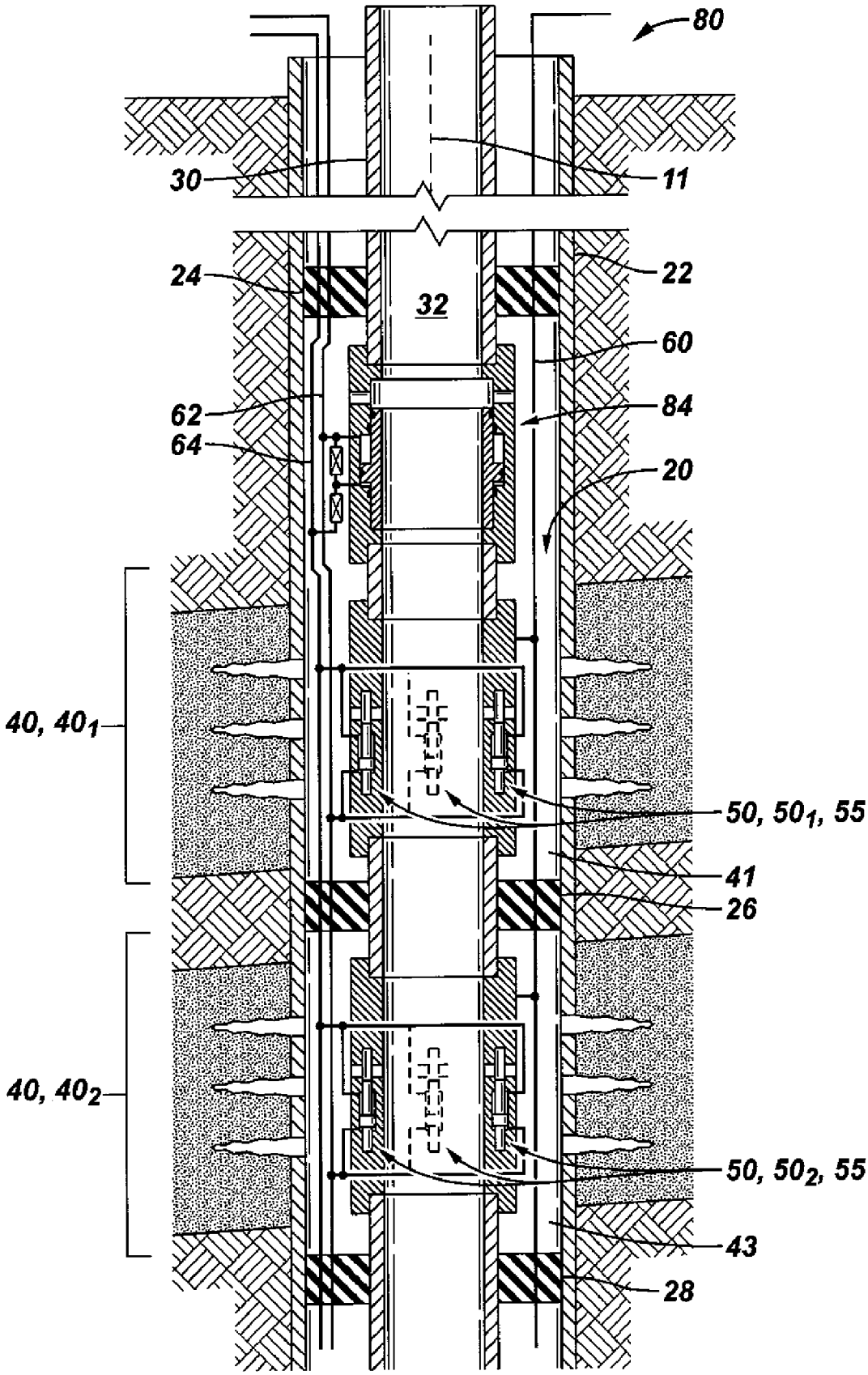

It is noted that a particular zone 40 may contain flow control valves other than the valves of the station 50, in accordance with embodiments of the invention. For example, FIG. 2 depicts a well 80 that is similar to the well 10 depicted in FIG. 1, with the same reference numerals being used to depict the same components. However, for the example depicted in FIG. 2, the zone $40_1$ includes an additional on/off-type valve 84 that is located in the zone $40_1$ with the station $50_1$. The valve 84 may be controlled, for example, using the same lines 60, 62 and 64 that are used for purposes of controlling the stations $50_1$ and $50_2$. Other variations are contemplated and are within the scope of the appended claims.

Figure 3:
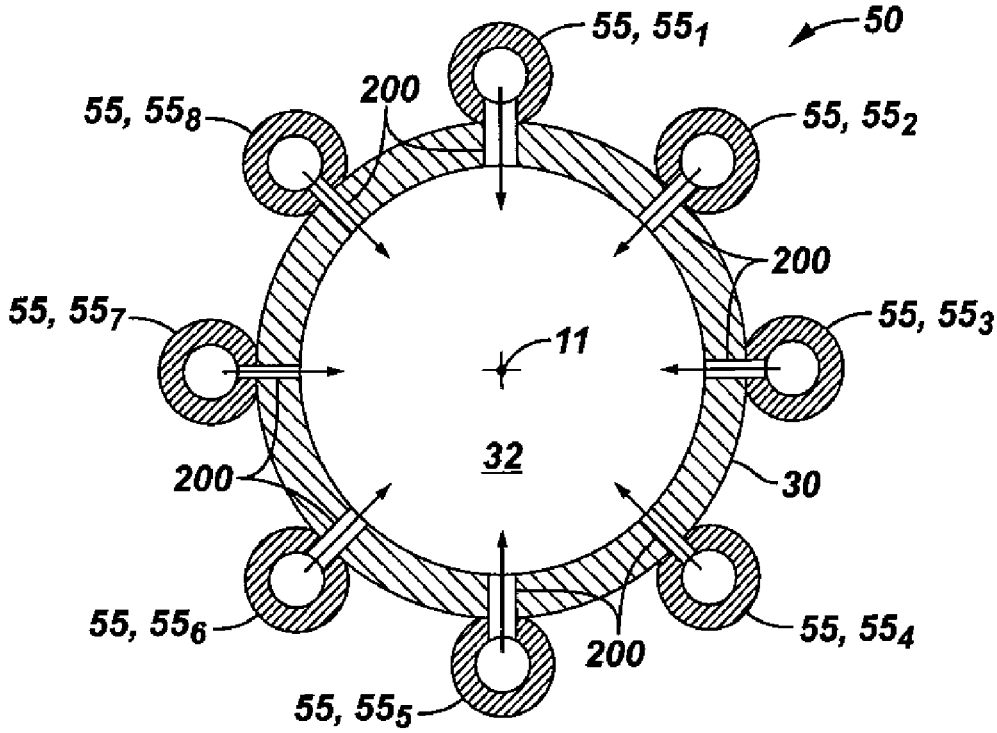
FIG. 3 is a cross-sectional diagram of a flow control valve platform taken along line 3-3 of FIG. 1 according to an embodiment of the invention.

FIG. 3 depicts a cross-sectional view of the station 50 taken along line 3-3 of FIG. 1 according to some illustrative embodiments of the invention. For this example, the station 50 is configured for a production application, as indicated by the arrows indicating flow direction in FIG. 3. The tubing string 32 therefore serves as a hub that receives well fluid from the open choke modules 55. As shown, the modules 55 may be external to the tubing string 30 and distributed in a pattern that is concentric to the longitudinal axis 11 of the string 30. Each module 55 has associated radial ports (not shown in FIG. 3) to communicate fluid between an internal space of the module 55 and the annulus of the well 10, and each module 55 generally has the same general cross-sectional size.

In accordance with some embodiments of the invention, the chokes of the modules 55 may be differently sized. However, in accordance with other embodiments of the invention, more than one module 55 may have the same sized choke. Although FIG. 3 depicts eight modules 55 (i.e., modules $55_1$, $55_2$, $55_3$, $55_4$, $55_5$, $55_6$, $55_7$, and $55_8$), it is understood that the station 50 may contain more or fewer than eight modules 55, depending on the particular embodiment of the invention.

Figure 4:
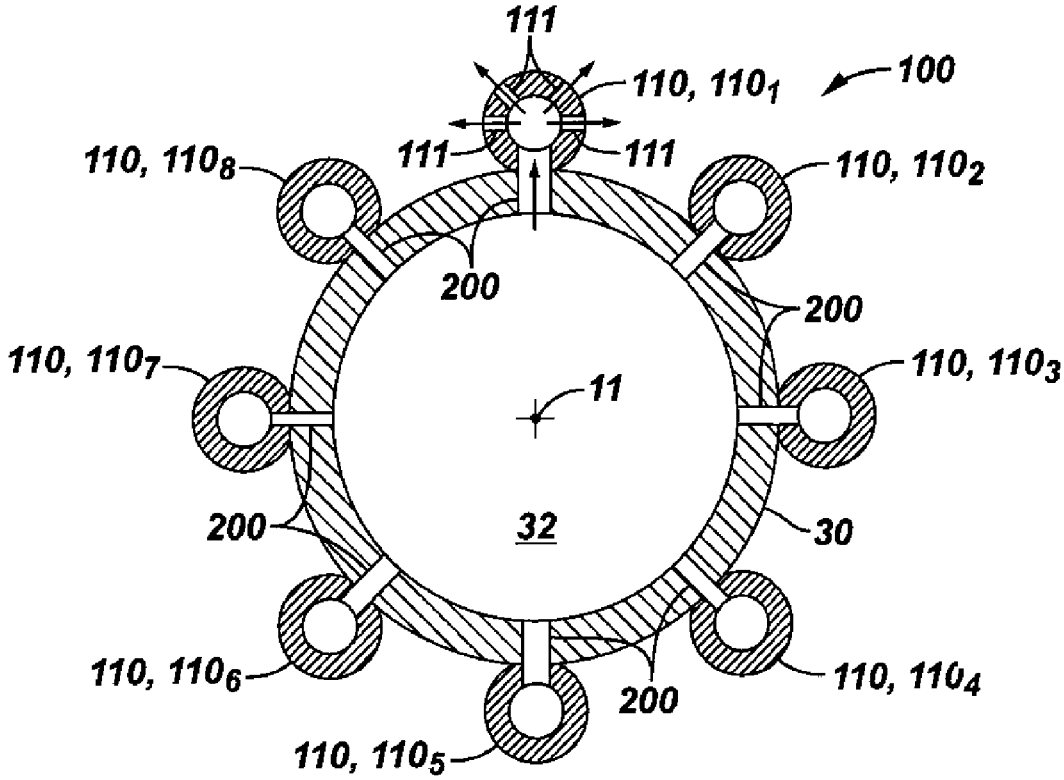
FIGS. 4 and 5 are cross-sectional views of flow control valve platforms according to other embodiments of the invention.

FIG. 4 depicts a station 100 that is specifically configured for an injection application, as denoted by the arrows. For this example, the modules 55 of FIG. 3 are replaced with modules 110 (modules $110_1$, $110_2$, $110_3$, $110_4$, $110_5$, $110_6$, $110_7$ and $110_8$, being depicted as examples). Similar to the station 50 depicted in FIG. 3, each module 110 has an associated choke 200, and the cross-sectional flow areas of the chokes 200 may vary among the modules 110. As shown in FIG. 4, for this injection example, the tubing string 30 serves as a hub, as injection flow passes through one or more of the chokes 200, such as indicated with arrows showing the direction of flow through the choke 200 associated with the module $110_1$. The flow passes through radial ports 111 into the annulus of the well 10.

Figure 5:
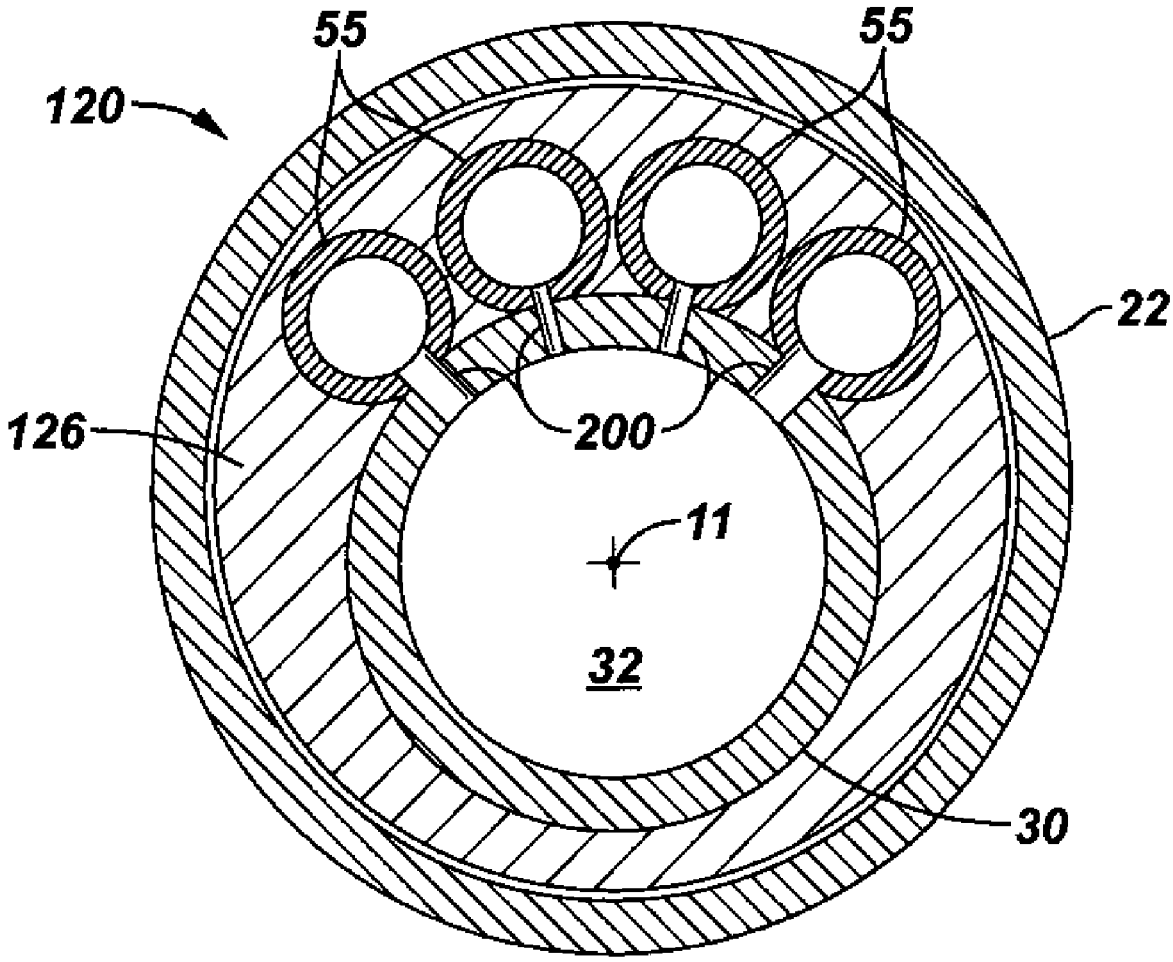

FIG. 5 depicts an alternative station 120 in which the modules 55 are eccentrically arranged about the longitudinal axis 11 of the tubing string 30. Due to the eccentric positioning of the modules 55, the tubing string 30 may be eccentrically disposed relative to the casing string 22. The station 120 may include an eccentrically-disposed mandrel 126 that contains openings configured for purposes of positioning the modules. Of course, the distribution of the modules 55 may vary in accordance with other embodiments of the invention.

Figure 6:
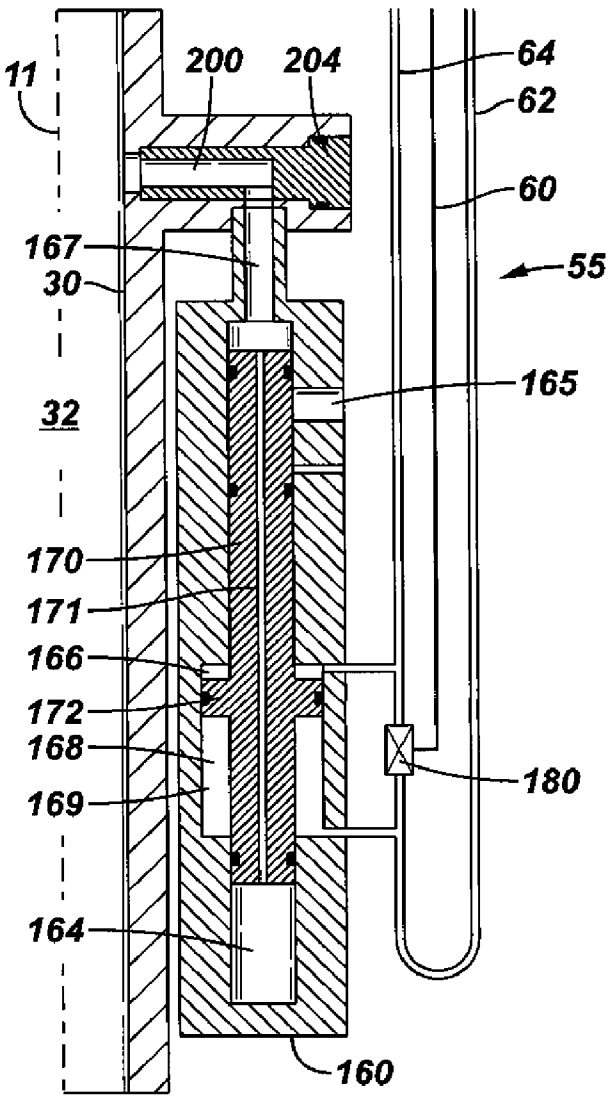

FIG. 6 depicts a cross-sectional view of the module 55 in accordance with some embodiments of the invention. In general, the module 55 may include an on/off valve that controls fluid communication through its choke 200, i.e., the valve controls fluid communication between the annular region that surrounds the module 55 and the central passageway 32 of the tubing string 30. In accordance with some embodiments of the invention, the valve is formed from a mandrel 170 that is disposed inside an interior space 164 of a housing 160 of the module 55. The mandrel 170 may have an axis that is substantially parallel to the longitudinal axis 11.

The mandrel 170 includes a piston head 166 that establishes two chambers in an annular cavity 169 of the interior space 164 for purposes of controlling the axial position of the mandrel 170: an upper chamber 166 that is in fluid communication with the hydraulic line 64 and the upper surface of the piston head 172; and a lower chamber 168 that is in fluid communication with the hydraulic line 62 and the lower surface of the piston head 172. When the pressure exerted on the piston head 172 by the fluid in the hydraulic line 64 exceeds the pressure exerted on the piston head 172 by the fluid in the hydraulic line 62, the mandrel 170 moves downwardly to a lower axial position (see FIG. 7, for example). Conversely, when the pressure exerted by the fluid in hydraulic line 62 on the piston head 172 exceeds the pressure exerted on the piston head 172 by the fluid in hydraulic line 64, the mandrel 170 moves to an upper axial position (as depicted in FIG. 6). The passageway 171 in the mandrel 170 allows fluid communication between cavities 167 and 164. The passageway 171 is configured to prevent or inhibit hydraulic lock and allows the mandrel 170 to move upwardly by transferring fluid from passageway 167 to interior space 164 through passageway 171 in the mandrel, or allows the mandrel to move downwardly by transferring fluid from the interior space 164 to the passageway 167.

In an upper axial position, the mandrel 170 blocks communication between the central passageway 32 of the tubing string 30 and one or more radial port(s) 165 (one radial port being depicted in FIG. 6) that are formed in the housing 160 and are in fluid communication with the annular region that surrounds the module 55. Thus, in the upper position, the mandrel 170 blocks fluid communication between the radial port(s) 165 and passageways 167 (one passageway being depicted in FIG. 6) that extend through the housing 160 to the choke 200. Conversely, in the lower position (see FIG. 7, for example), the valve is open and the radial ports 164 and passageway 32 are in communication.

Module 55 may further include a control valve 180 (such as a solenoid valve or other type of valve that opens and closes to allow or block the fluid flow in the communication line, for example) that selectively establishes communication between the hydraulic lines 62 and 64 and controls when the differences in pressure between the lines 62 and 64 may be used to change the state of the module 55. FIG. 6 depicts the valve 180 as being open, which prevents the state of the module 55 from changing due to the equalization of pressure between the lines 62 and 64. Therefore, as long as the valve 180 remains open, the mandrel 170 remains in the upper position, regardless of the pressures exerted by the hydraulic lines 62 and 64.

Figure 7:
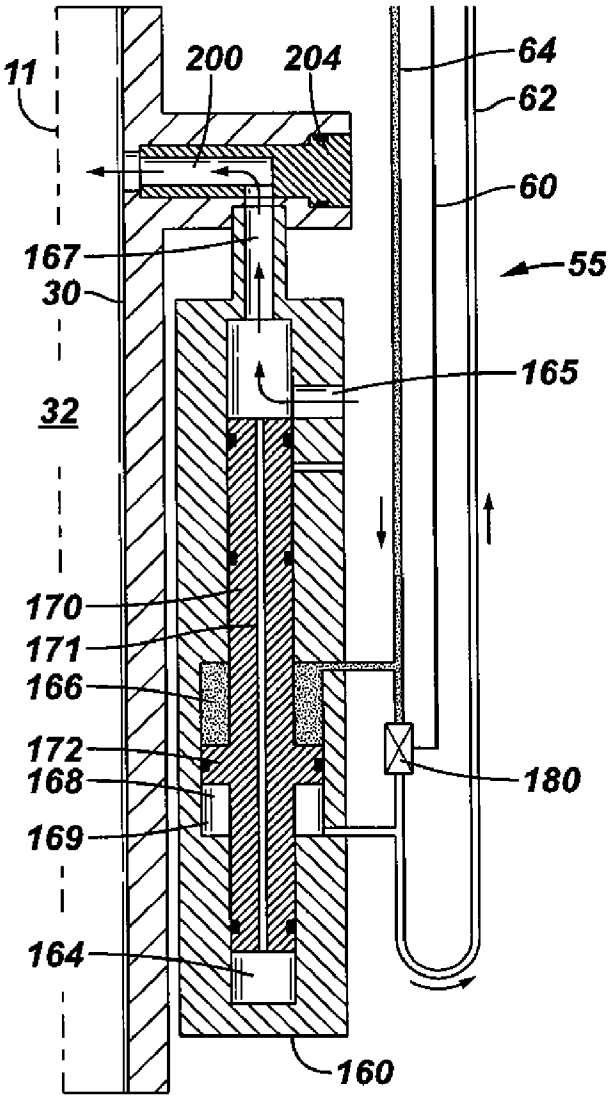
FIGS. 6, 7, 8, 9 and 10 are partial cross-sectional views of a flow control valve module in different states according to embodiments of the invention.

Referring to FIG. 7, to open communication through the choke 200, the following control occurs. First, the control valve 180 is closed, which allows the mandrel 170 to respond to pressure differences between the hydraulic lines 62 and 64. Next, hydraulic line 62 is configured to communicate, transfer, remove, or dump, fluid from the lower chamber 168. In other words, the hydraulic line 62 is configured to return hydraulic fluid to the surface of the well 10. Pressurization of the hydraulic line 64 exerts a downward force on the piston head 172, which causes the mandrel 170 moves to the lower axial position, as depicted in FIG. 7. For this position of the mandrel 170, the module 55 permits fluid communication through a path that includes the radial port(s) 165, passageways 167 and the choke 200.

Figure 8:
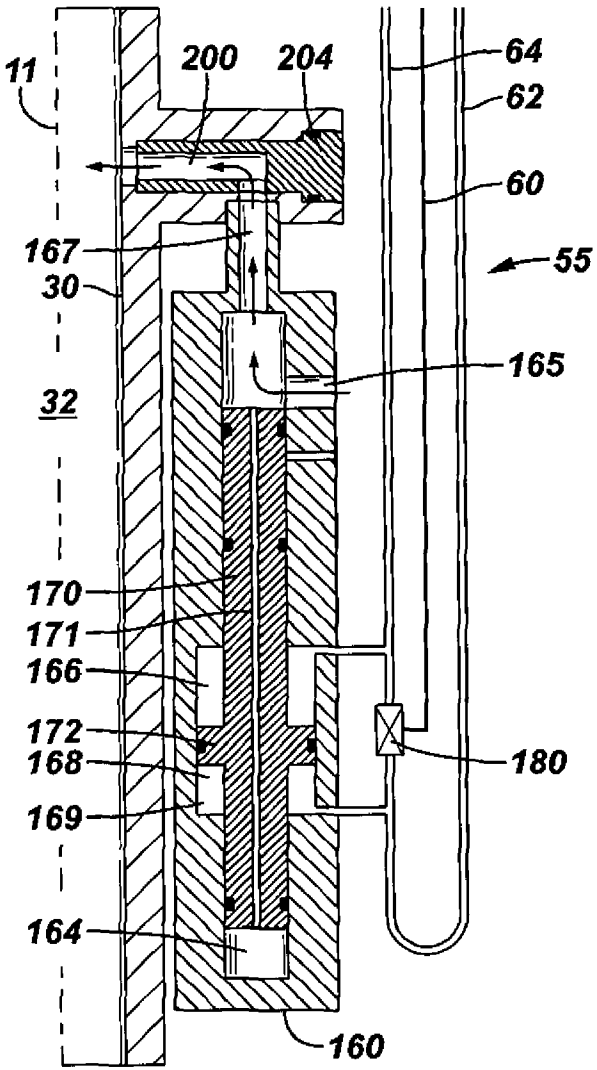

FIG. 8 depicts the module 55 open and configured to not respond to pressures that are exerted by the hydraulic lines 62 and 64. More specifically, the difference between FIGS. 7 and 8 is that the control valve 180 is open, which equalizes pressures in the hydraulic lines 62 and 64.

Figure 9:
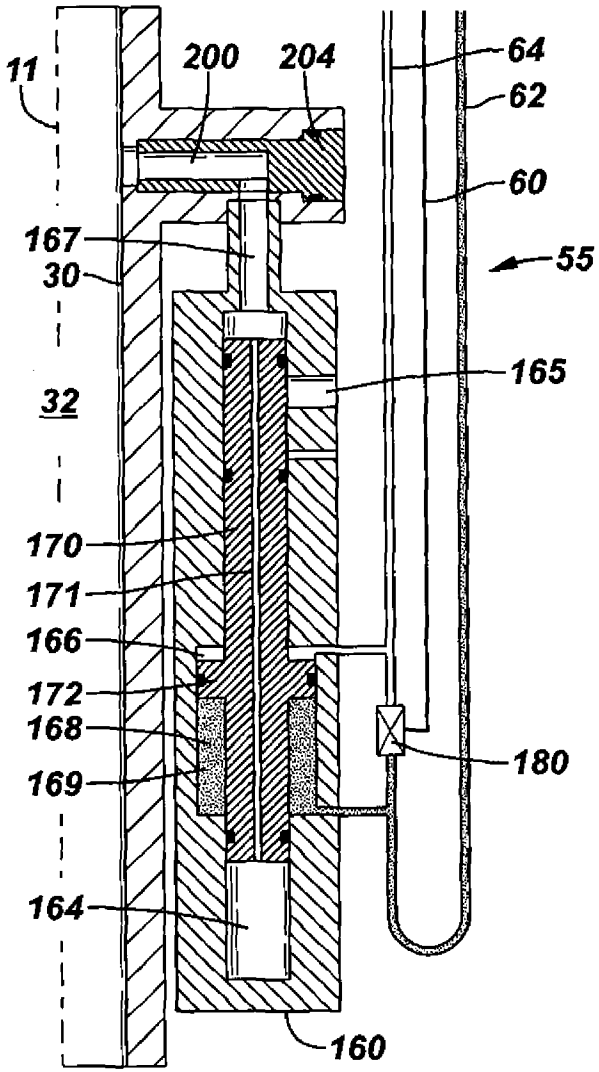

For purposes of closing communication through the choke 200, the mandrel 170 may be moved upwardly to its closed position, as depicted in FIG. 9. For this to occur, the control valve 180 is closed, thereby isolating the hydraulic lines 62 and 64 and enabling the mandrel 170 to respond to pressure differences in the hydraulic lines 62 and 64. Next, the hydraulic line 64 is configured to allow fluid from the upper chamber 166 to transition into hydraulic line 64, and the hydraulic line 62 is pressurized. This creates a differential pressure across the piston head 172 in order to move the mandrel 170 back to an upper axial position and thereby close communication through the choke 200.

Figure 10:
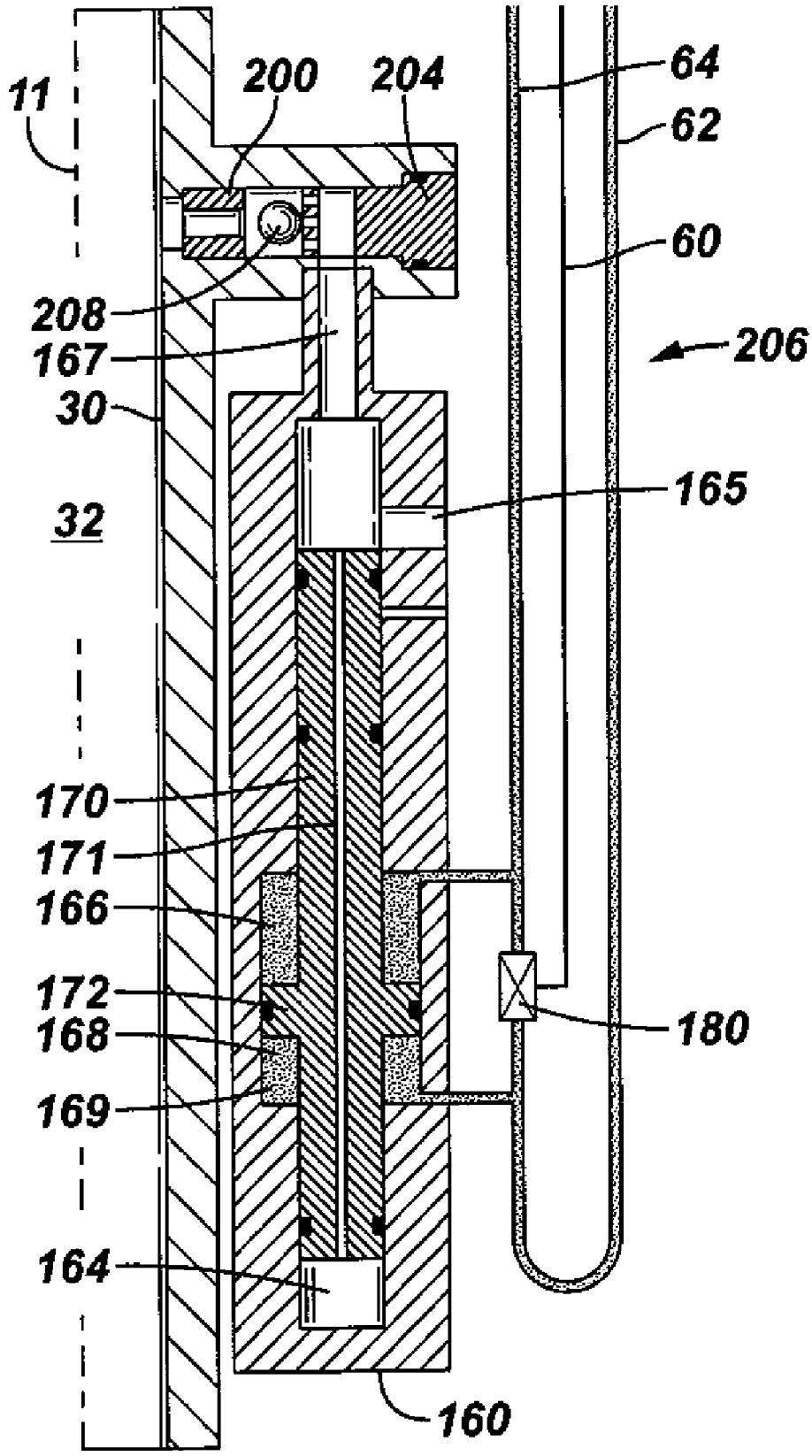

FIG. 10 depicts an open state for a module 206, which has a similar design to the module 55, with similar reference numerals used to denote similar components. However, the module 206 is used primarily for purposes of injection. Thus, the arrows in FIG. 10 depict a flow from the central passageway 32, through the choke 200 and into the radial port 165, for exit into the annulus of the well. Unlike module 55, however, a backflow prevention device, such as a check valve 208, is disposed in the flow path, such as downstream or upstream (as shown) of the choke 200, for purposes of preventing flow through the choke 200 in a direction from the radial ports 165 to the passageway 32. Thus, only an injection flow occurs through the choke 200 when the mandrel 170 is in the lower position, as depicted in FIG. 10. In other embodiments, the module 55 may be run without a back flow prevention device, such as the check valve 208 for example, for the purposes of injection. It is noted that for the state of the module 206 depicted in FIG. 10, the valve 180 is open to equalize pressure between the hydraulic lines 62 and 64 such that the module 206 does not change states regardless of the pressures exerted by the hydraulic lines 62 and 64.

Among other features, the module 55 (see FIG. 6, for example) or module 206 (see FIG. 10) may include a longitudinal pressure equalization passageway 171 that traverses the length of the mandrel 170 for purposes of equalizing pressure above and below the mandrel 170. Additionally or instead of, the module 55 or 206 may include a sealed and removable plug 204 for purposes of allowing relatively easy external access to the choke 200 of the module 55 or 206 with requiring disassembly of the tubing string 30. In this regard, the plug 206 may be removed at the surface of the well for purposes of installing the appropriately-sized choke 200 for the particular application and/or for purposes of configuring the module 55 or 206 for injection or production. In some alternative embodiments, the module 55 or 206 may include a gas or mechanical spring (not shown) to bias the mandrel 170 in one direction or another.

Figure 11:
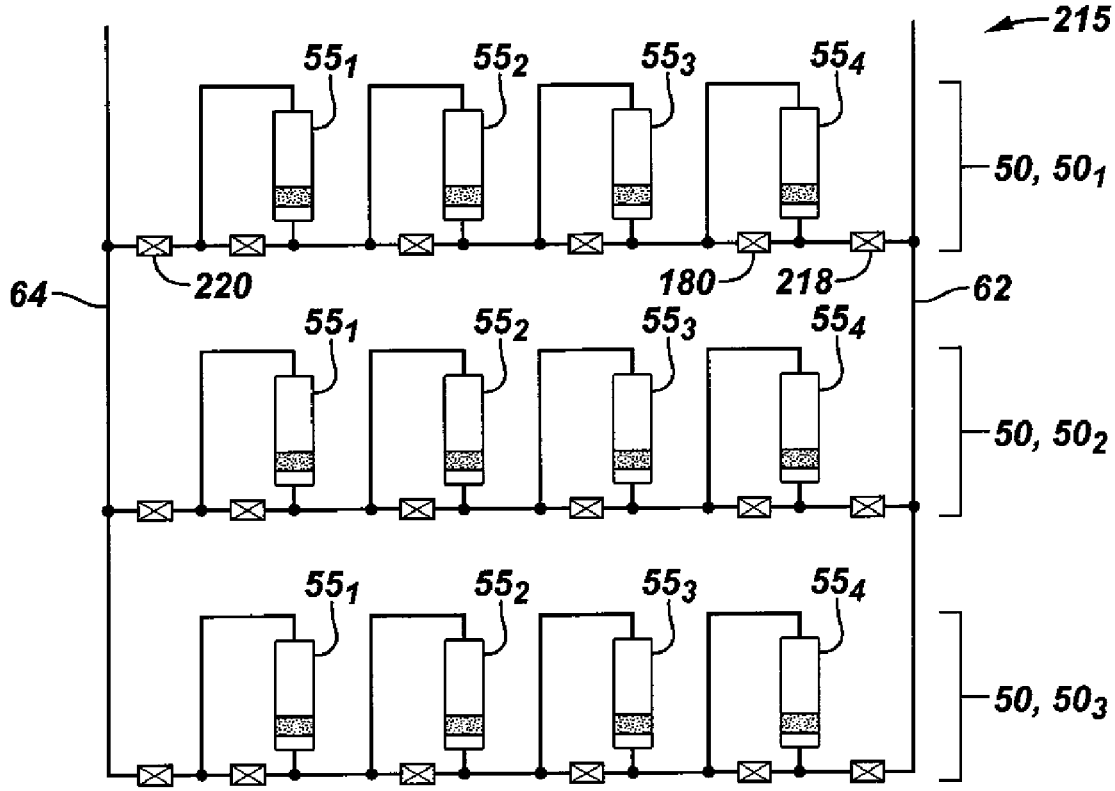
FIGS. 11, 12, 13, 14, 15, 16, 17, 18, 19, 20 and 21 are schematic diagrams of a flow control valve platform in different states according to embodiments of the invention.
Figure 12:
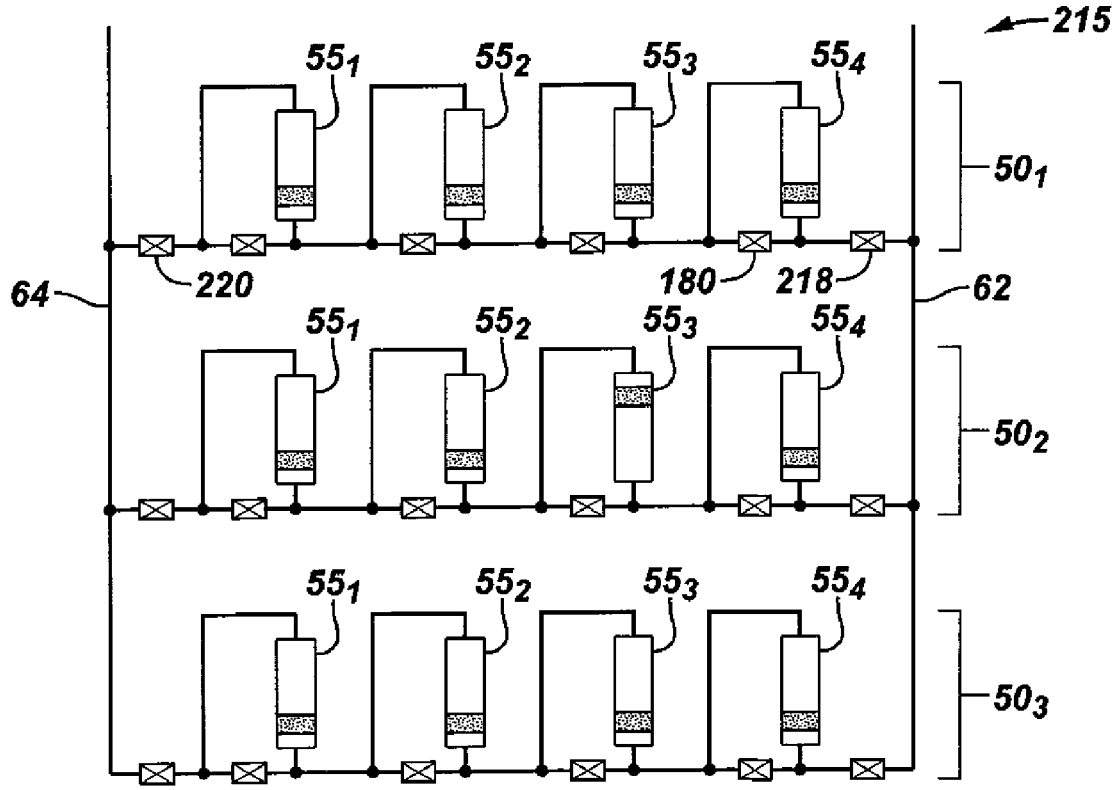

FIG. 11 depicts an exemplary flow control valve platform 215 in accordance with some embodiments of the invention. For this example, the platform 215 includes three exemplary stations $\mathbf{50}_1$, $\mathbf{50}_2$ and $\mathbf{50}_3$, which are operated by the electric and hydraulic lines 60, 62 and 64. In general, each station 50 includes four modules 55 (i.e., modules $\mathbf{55}_1$, $\mathbf{55}_2$, $\mathbf{55}_3$ and $\mathbf{55}_4$), which are hydraulically connected so that the upper chamber 166 (see FIG. 6, for example) of each module 55 is hydraulically coupled to the lower chamber 168 (see FIG. 6, for example) of another module 55; and the upper 166 and lower 168 chambers of each module 55 are separated by a respective control valve 180.

More specifically, for the station $\mathbf{50}_1$, the lower chamber 168 of the module $\mathbf{55}_1$ is hydraulically coupled to the upper chamber 166 of the module $\mathbf{55}_2$; the lower chamber 168 of the station $\mathbf{55}_2$ is hydraulically coupled to the upper chamber 166 of the module $\mathbf{55}_3$; and the lower chamber 168 of the station $\mathbf{55}_3$ is hydraulically coupled to the upper chamber 166 of the module $\mathbf{55}_4$. Additionally, a control valve 220 (an electrically-controlled solenoid valve, for example) controls communication between the upper chamber 166 of the module $\mathbf{55}_1$ and the hydraulic line 64; and another control valve 218 (an electrically-controlled solenoid valve, for example) controls hydraulic communication between the lower chamber 168 of the module $\mathbf{55}_4$ and the hydraulic line 62. As depicted in FIG. 11, the modules 55 of the other two stations $\mathbf{50}_2$ and $\mathbf{50}_3$ are hydraulically connected together and to the hydraulic lines 62 and 64 in a similar manner, in accordance with some embodiments of the invention.

For purposes of example, the flow control valve platform 215 is depicted in FIG. 11 in a state in which all of the modules 55 are open. It is noted that this state may be used for the initial run-in-hole state of the platform 215; and thereafter, the hydraulic lines 62 and 64 may be selectively pressurized and the control valves 180, 218 and 220 may be selectively operated to control which modules 55 are open and which modules 55 are closed.

Proceeding FIGS. 12, 13, 14, 15, 16, 17, 18, 19, 20 and 21 depict an exemplary sequence showing the transition of the platform 215 from the initial state of FIG. 11 through other exemplary states for purposes of illustrating operation of the platform 215. More specifically, referring to FIG. 12, to close the module $\mathbf{55}_3$ of station $\mathbf{50}_2$, the hydraulic line 62 is pressurized, and the hydraulic line 64 is used as the dump line. For purposes of isolating the modules 55 of the stations $\mathbf{50}_1$ and $\mathbf{50}_3$ from the pressure in the hydraulic line 62, the control valves 218 of the stations $\mathbf{50}_1$ and $\mathbf{50}_3$ are closed. The control valve 218 of the station $\mathbf{50}_2$ remains open, and the control valve 180 associated with the module $\mathbf{55}_3$ is closed. Therefore, due to this configuration, pressure communicated by the hydraulic line 62 opens the module $\mathbf{55}_3$. It is noted that the other modules $\mathbf{55}_1$, $\mathbf{55}_2$ and $\mathbf{55}_4$ of the station $\mathbf{50}_2$ remain open, due to their associated control valves 180 being open.

Figure 13:
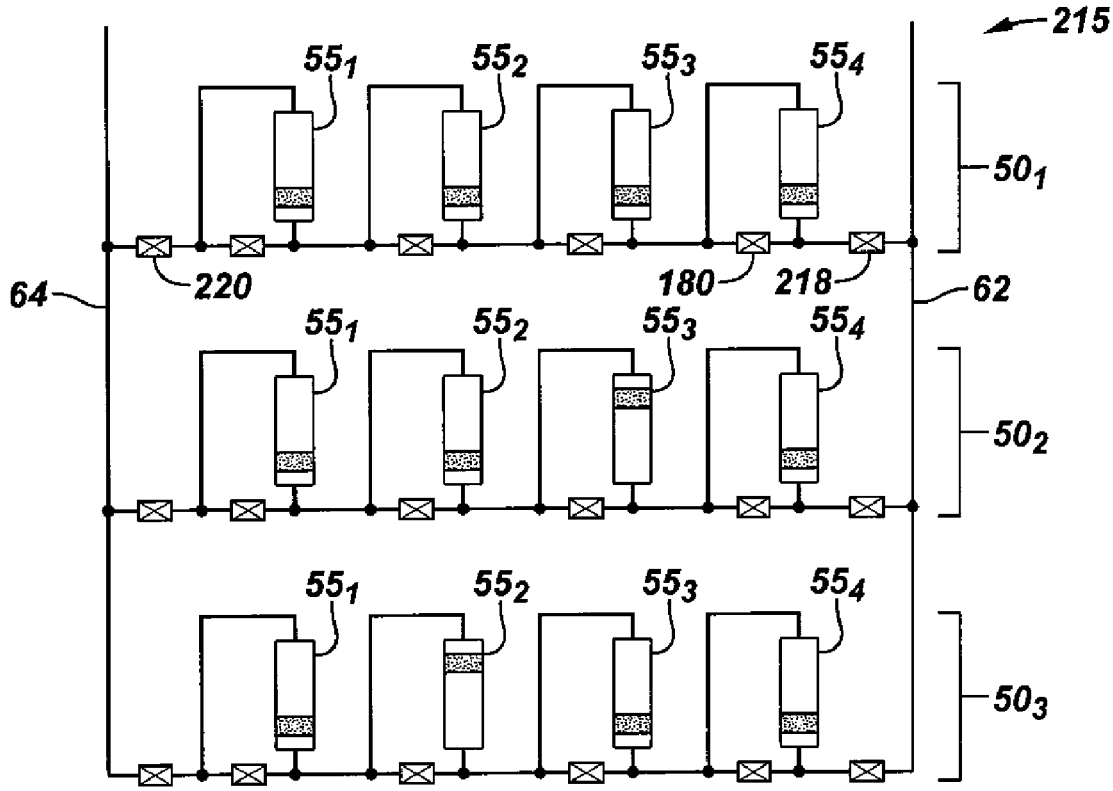

Referring to FIG. 13, to close the module $\mathbf{55}_2$ of station $\mathbf{50}_3$, the control valves 218 of the stations $\mathbf{50}_1$ and $\mathbf{50}_2$ are closed, and the control valve 218 of the station $\mathbf{50}_3$ is open. Furthermore, the control valve 180 of the module $\mathbf{55}_2$ of station $\mathbf{50}_3$ is closed, and the other control valves 180 are open. Therefore, pressurization of the hydraulic line 62 transitions the module to its closed state.

Figure 14:
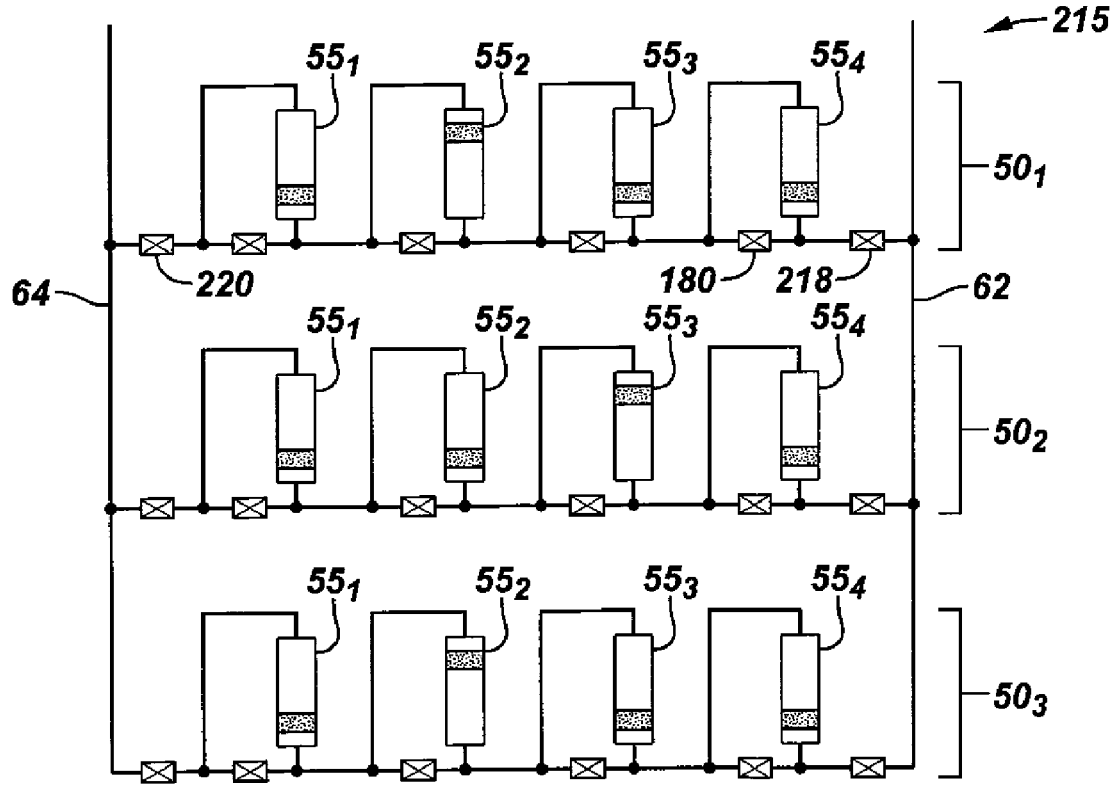

Referring to FIG. 14, to close the module $\mathbf{55}_2$ of station $\mathbf{50}_1$, the stations $\mathbf{50}_2$ and $\mathbf{50}_3$ are isolated from the hydraulic line 62 by closing the control valves 218 of the stations; the control valve 218 of the station $\mathbf{50}_1$ is open, and the control valve 180 of the module $\mathbf{55}_2$ is closed. With this arrangement, pressurization of the hydraulic line 62 causes the module $\mathbf{55}_2$ to close.

Figure 15:
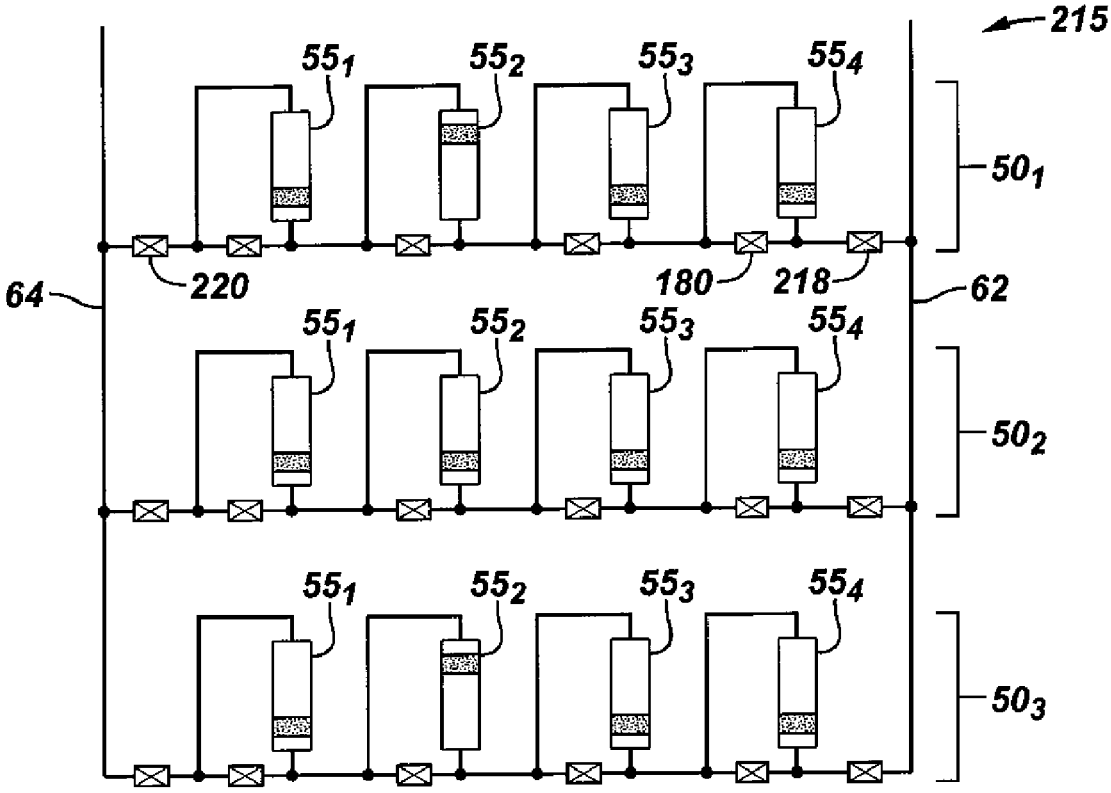

For purposes of opening a selected module 55, the hydraulic line 64 is pressurized, and the hydraulic line 62 is used as the dump line. Referring to FIG. 15, as a more specific example, to open the module $\mathbf{55}_3$ of station $\mathbf{50}_2$, the control valves 220 of the stations $\mathbf{50}_1$ and $\mathbf{50}_3$ are closed to isolate the stations from pressure in the hydraulic line 64. The control valve 220 of the station $\mathbf{50}_2$ remains open, and the control valve 180 of the module $\mathbf{55}_3$ of the station $\mathbf{50}_2$ is closed so that when the hydraulic line 64 is pressurized, the module $\mathbf{55}_3$ opens, as depicted in FIG. 15.

Figure 16:
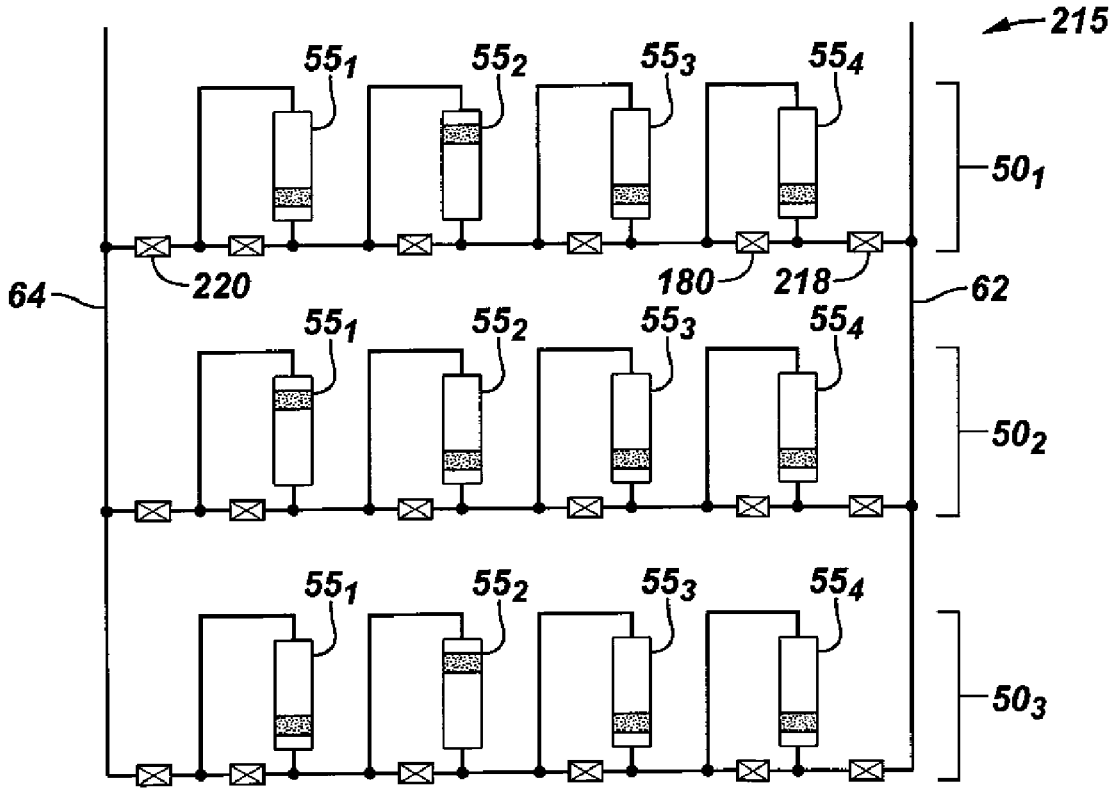

Referring to FIG. 16, as another example, to close the module $\mathbf{55}_1$ of station $\mathbf{50}_2$, the control valves 218 of the stations $\mathbf{50}_1$ and $\mathbf{50}_3$ are closed to isolate the stations $\mathbf{50}_1$ and $\mathbf{50}_3$ from the hydraulic line 62. The control valve 218 of the station $\mathbf{50}_2$ remains open, and the control valve 180 of the module $\mathbf{55}_1$ is closed so that pressurization of the hydraulic line 62 causes the module $\mathbf{55}_1$ of the station $\mathbf{50}_2$ to close.

Figure 17:
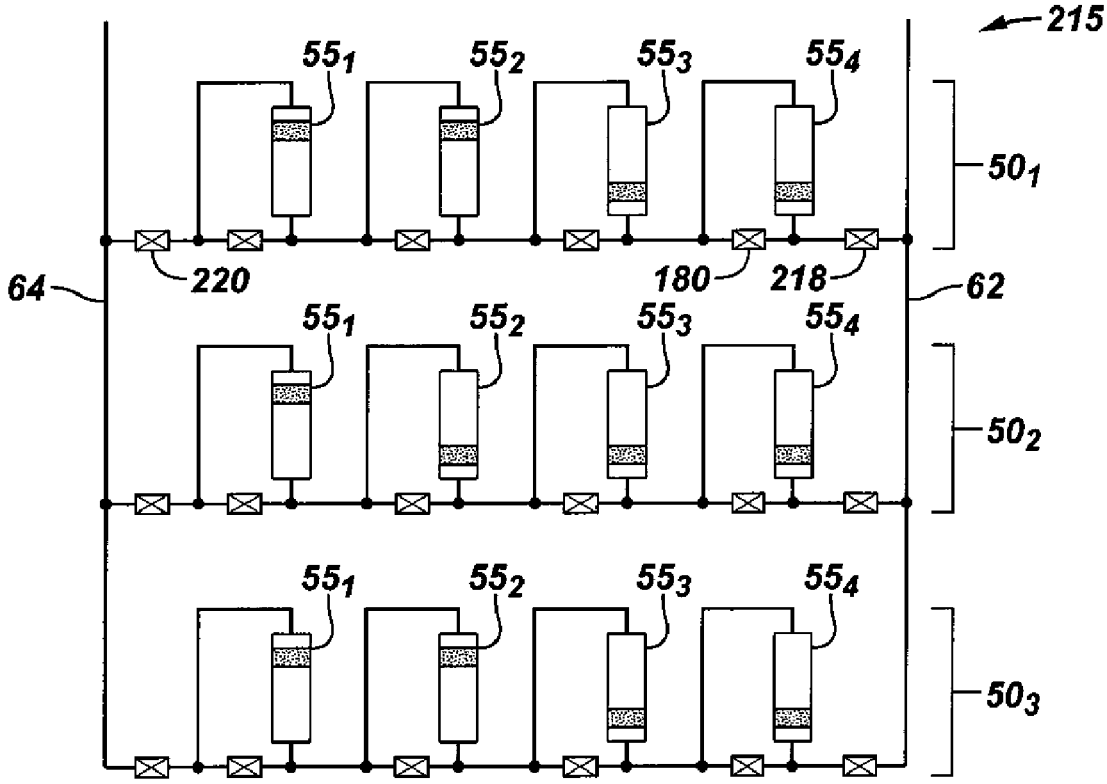

FIGS. 17, 18, 19 and 20 depict a sequence to close all of the modules 55 of the platform 215. More specifically, in accordance with embodiments of the invention, the modules 55 may be closed in a sequence that involves simultaneously closing all of the modules $\mathbf{55}_1$; subsequently and concurrently closing all of the modules $\mathbf{55}_2$; subsequently and concurrently closing all of the modules $\mathbf{55}_3$; and lastly, concurrently closing all of the modules $\mathbf{55}_4$. FIG. 17 depicts the state of the flow control valve platform 215 for purposes of closing the modules $\mathbf{55}_1$. As shown in FIG. 17, all of the control valves 218 and 220 are open, and the control valves 180 of the modules $\mathbf{55}_1$ are closed. Pressurization of the hydraulic line 62 closes all of the modules $\mathbf{55}_1$.

Figure 18:
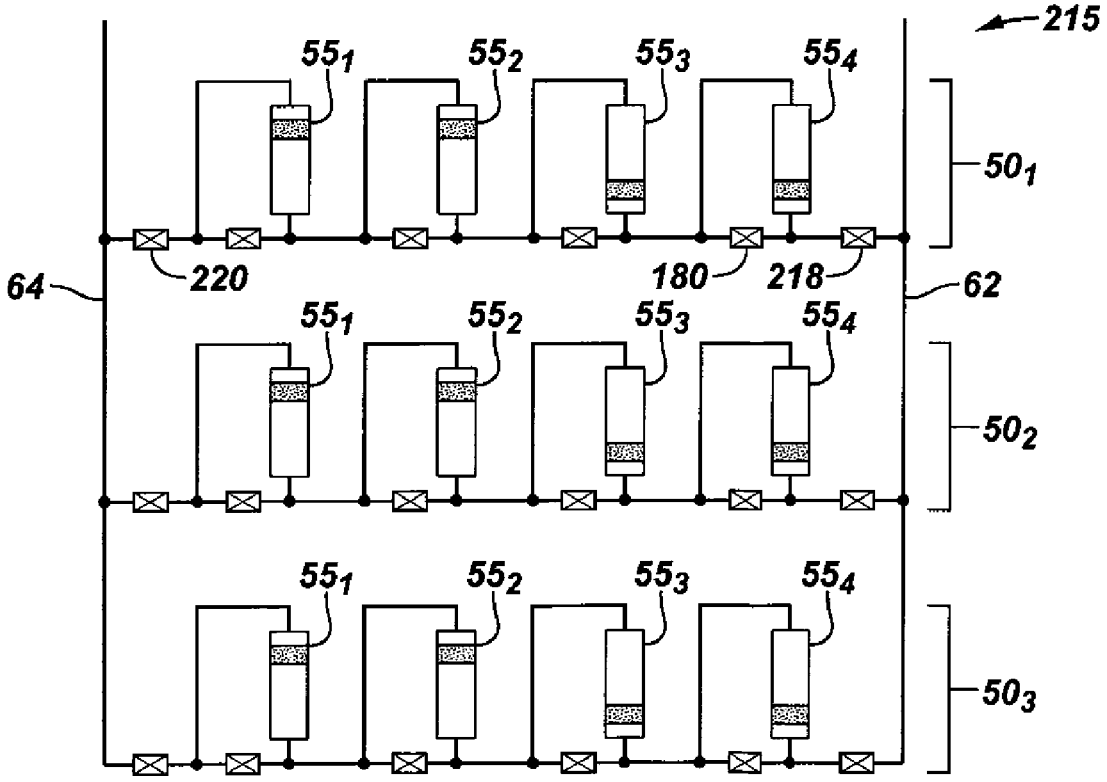

Referring to FIG. 18, the modules $\mathbf{55}_2$ are closed in a similar manner. More specifically, all of the control valves 218 and 220 remain open; the control valves 180 of three modules $\mathbf{55}_2$ are closed; and all of the remaining control valves 180 remain open. Pressurization of the hydraulic line 62 causes all of the modules $\mathbf{55}_2$ to close.

Figure 19:
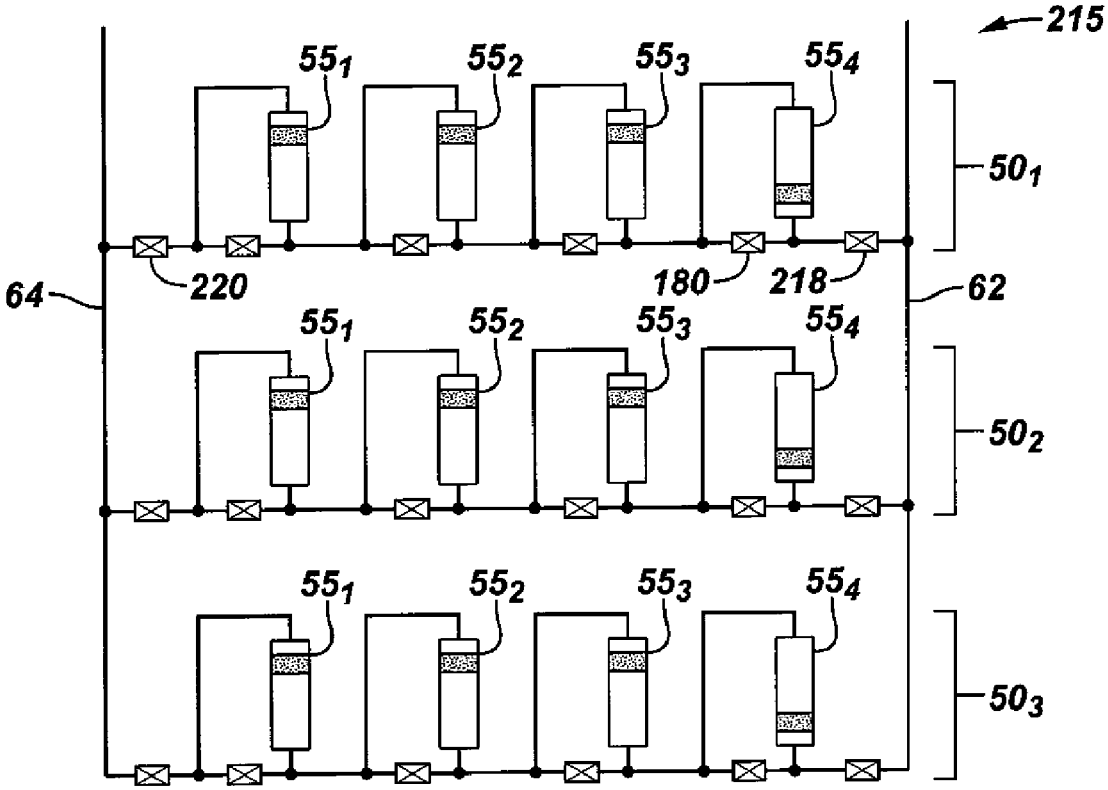
Figure 20:
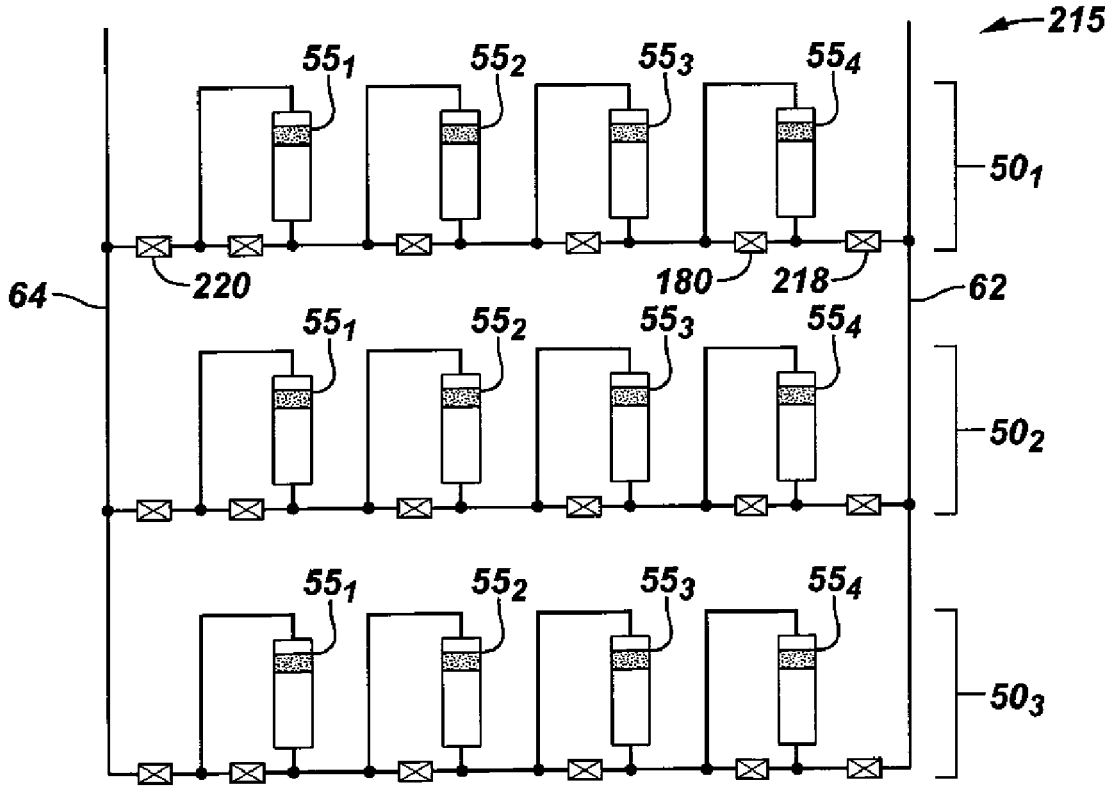

Referring to FIG. 19, subsequently, the modules $\mathbf{55}_3$ are all closed in a similar manner by closing the control valves 180 of the modules $\mathbf{55}_3$, with the remaining control valves being left open. Subsequent pressurization of the hydraulic line 62 therefore closes all of the modules $\mathbf{55}_3$. Referring to FIG. 20, likewise, all of the modules $\mathbf{55}_4$ are closed by closing the control valves 180 of the modules $\mathbf{55}_4$, leaving the remaining control valves open and pressurizing the hydraulic line 62.

Figure 21:
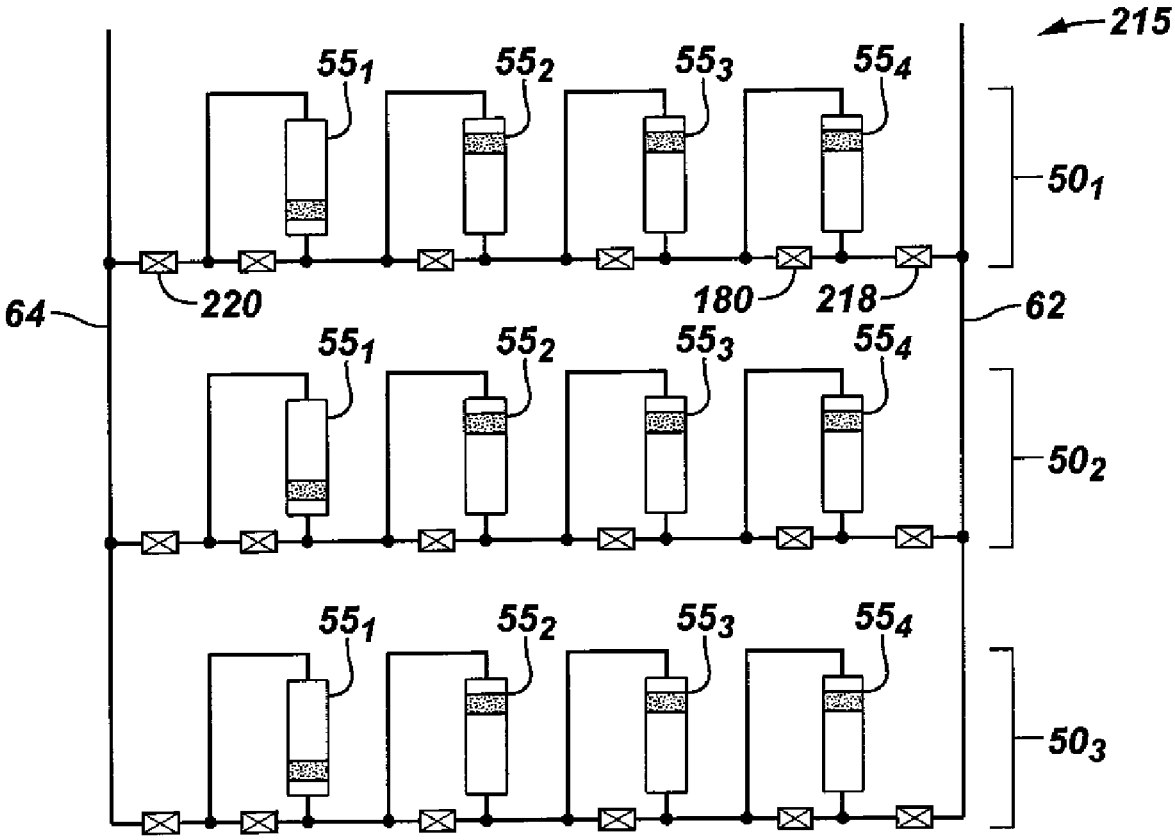

Referring to FIG. 21, all of the modules 55 of the flow control valve platform 215 may be opened in a four step sequence that involves simultaneously opening all of the modules $\mathbf{55}_1$; subsequently simultaneously opening all of the modules $\mathbf{55}_2$; subsequently simultaneously opening all of the modules $\mathbf{55}_3$; and lastly, simultaneously opening all of the modules $\mathbf{55}_4$. To open each set of modules 55, the hydraulic line 64 is pressurized, and the hydraulic line 62 serves as a dump line. The control lines 218 and 220 remain open, and the control valves 180 of the modules 55 being opened are closed, with the remaining control valves 180 being left open. FIG. 21 depicts the first step in the sequence to open the modules $\mathbf{55}_1$ of all three stations $\mathbf{50}_1$, $\mathbf{50}_2$and $\mathbf{50}_3$. As shown, the control valves 180 of the modules $\mathbf{55}_1$, $\mathbf{55}_2$ and $\mathbf{55}_3$ are closed, with the remaining control valves being left open. Pressurization of the hydraulic line 64 therefore causes each of the modules $\mathbf{55}_1$ to open, as depicted in FIG. 21. The remaining modules $\mathbf{55}_2$, $\mathbf{55}_3$ and $\mathbf{55}_4$ of all three stations $\mathbf{50}_1$, $\mathbf{50}_2$ and $\mathbf{50}_3$ are opened in three successive and similar sequences.

Figure 22:
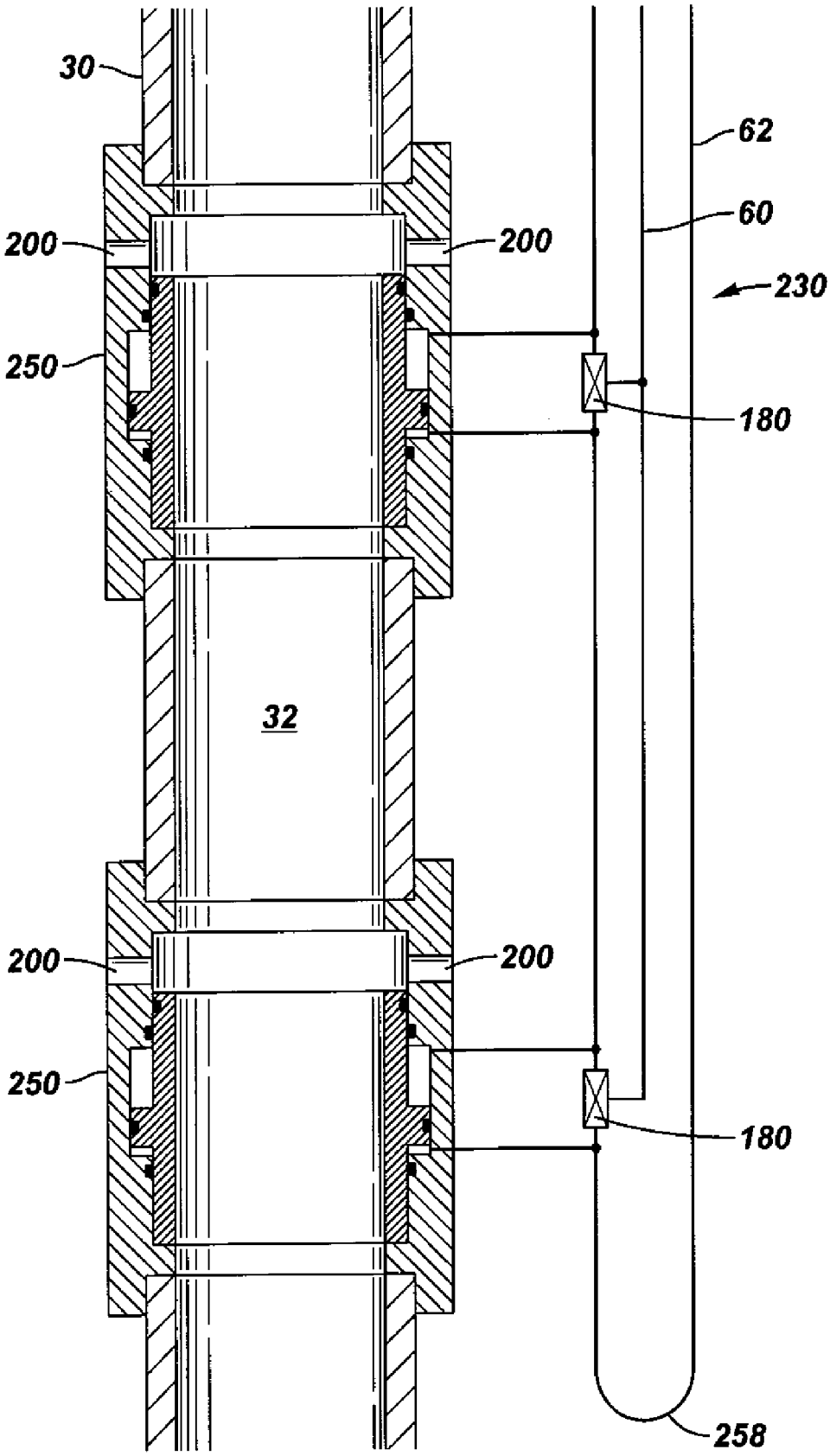
FIG. 22 is a schematic diagram of a flow control valve platform according to another embodiment of the invention.

Other embodiments are contemplated and are within the scope of the appended claims. For example, referring to FIG. 22, in accordance with other embodiments of the invention, a flow control platform 230 may be formed from modules 250 that are axially arranged along the tubing string 30. Therefore, many variations are contemplated and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system usable with a well, comprising:

a tubing extending into an isolated zone of the well;

a plurality of choke modules disposed in the isolated zone to control communication between the tubing passageway and the zone, each choke module comprising an associated choke that is removable from the module without disassembly of the tubing and each choke module being independently controllable relative to the other of the plurality of choke modules downhole in the well to selectively enable and disable flow through the associated choke wherein the choke modules are radially distributed about a longitudinal axis of the tubing; and a casing, wherein the choke modules are radially distributed through a limited angular range about a circumference of the tubing, and the tubing is eccentrically disposed with respect to the casing.

2. The system of claim 1, wherein at least one of the associated chokes has a different cross-sectional flow path area from another of the associated chokes.

3. The system of claim 1, wherein at least one of the associated chokes has a cross-sectional flow path area substantially equal to another of the associated chokes.

4. The system of claim 1, further comprising:

flow control valves, each valve being associated with at least one of the plurality of choke modules to selectively enable and disable flow through the respective chokes.

5. The system of claim 4, further comprising first and second hydraulic lines configured to actuate the flow control valves.

6. The system of claim 5, further comprising:

another plurality of choke modules disposed in another isolated zone to control communication between the tubing passageway and said another zone, said another plurality of choke modules being controlled by the first and second hydraulic lines.

7. The system of claim 5, further comprising additional valves, each additional valve being associated with at least one of the flow control valves to control communication between the first and second hydraulic lines and the associated flow control valve.

8. The system of claim 7, wherein each additional valve comprises an electrically operable valve.

9. The system of claim 8, wherein the choke modules are radially distributed about a circumference of the tubing.

10. The system of claim 1, wherein the choke modules further comprise a check valve for substantially unidirectional flow.

11. A system usable with a well, comprising:

a tubing extending into an isolated zone of the well;

a plurality of choke modules disposed in the isolated zone to control communication between the tubing passageway and the zone, each choke module comprising an associated choke that is removable from the module without disassembly of the tubing and each choke module being independently controllable relative to the other of the plurality of choke modules downhole in the well to selectively enable and disable flow through the associated choke;

a plurality of flow control valves, each valve being associated with at least one of the plurality of choke modules to selectively enable and disable flow through the respective chokes;

a first and second hydraulic line configured to actuate the flow control valves; and a plurality of additional valves, each additional valve being associated with at least one of the flow control valves to control communication between the first and second hydraulic lines and the associated flow control valve.

12. The system of claim 11, wherein at least one of the associated chokes has a different cross-sectional flow path area from another of the associated chokes.

13. The system of claim 11, wherein at least one of the associated chokes has a cross-sectional flow path area substantially equal to another of the associated chokes.

14. The system of claim 13, further comprising:

another plurality of choke modules disposed in another isolated zone to control communication between the tubing passageway and said another zone, said another plurality of choke modules being controlled by the first and second hydraulic lines.

15. The system of claim 14, wherein each additional valve comprises an electrically operable valve.

16. The system of claim 15, wherein the choke modules are radially distributed about a circumference of the tubing.

17. The system of claim 11, wherein the choke modules are radially distributed about a longitudinal axis of the tubing.

18. The system of claim 17, further comprising:

a casing, wherein the choke modules are radially distributed through a limited angular range about a circumference of the tubing, and the tubing is eccentrically disposed with respect to the casing.

19. The system of claim 11, wherein the choke modules further comprise a check valve for substantially unidirectional flow.

* * * * *